US007291819B2

(12) United States Patent
Kim et al.

(10) Patent No.: US 7,291,819 B2
(45) **Date of Patent: *Nov. 6, 2007**

(54) HEATING APPARATUS USING ELECTROMAGNETIC WAVE

(75) Inventors: Eung Su Kim, Seoul (KR); Jin Yul Hu, Seoul (KR); Sung Hun Sim, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/263,969

(22) Filed: Nov. 2, 2005

(65) Prior Publication Data

US 2007/0039952 A1 Feb. 22, 2007

(30) Foreign Application Priority Data

Aug. 22, 2005 (KR) ..... 10-2005-0076739

(51) Int. Cl.
*H05B 6/76* (2006.01)

(52) U.S. Cl. ..... 219/742; 219/739; 174/374; 174/388

(58) Field of Classification Search ..... 219/739–743, 219/756; 174/35 GC, 35 MS, 374, 388
See application file for complete search history.

(56) References Cited

U.S. PATENT DOCUMENTS 4,102,041 A * 7/1978 Copping et al. ..... 219/742
4,166,207 A * 8/1979 Burke ..... 219/741
4,313,044 A * 1/1982 Staats ..... 219/742
4,390,767 A * 6/1983 Bucksbaum et al. ..... 219/740
4,471,194 A * 9/1984 Hosokawa et al. ..... 219/742
5,036,171 A * 7/1991 Kim et al. ..... 219/742

FOREIGN PATENT DOCUMENTS

JP 52-3744 * 1/1977

* cited by examiner

*Primary Examiner*—Philip H. Leung
(74) *Attorney, Agent, or Firm*—Birch, Stewart, Kolasch & Birch, LLP

(57) ABSTRACT

A heating apparatus using an electromagnetic wave is disclosed, by which a capacity of a cavity is increased and by which cut-off performance of the electromagnetic wave and facilitation of door cleaning can be enhanced. The present invention includes a door provided to an open front side of a body to be opened/closed, a choke filter having a panel type choke part arranged by at least one or more rows along an edge of the door and a filter part having a plurality of slots wherein a prescribed choke part is provided to a most outer side, and a glass panel attached to an inner lateral side of the door and the choke filter.

13 Claims, 5 Drawing Sheets

HEATING APPARATUS USING ELECTROMAGNETIC WAVE

This application claims the benefit of the Korean Patent Application No. P2005-0076739, filed on May 22, 2005, which is hereby incorporated by reference as if fully set forth herein.

BACKGROUND OF THE INVENTION

1. Field of the Invention

The present invention relates to a heating apparatus, and more particularly, to a heating apparatus using an electromagnetic wave. Although the present invention is suitable for a wide scope of applications, it is particularly suitable for increasing a capacity of a cavity, enhancing cut-off performance of the electromagnetic wave, and enhancing facilitation of door cleaning.

2. Discussion of the Related Art

Generally, an electronic oven, a microwave oven and the like are devices for heating food and drink using an electromagnetic wave. And, a heating apparatus using an electromagnetic wave is the general term for theses devices.

A heating apparatus using an electromagnetic wave according to a related art includes a choke filter provided to an edge of a door to prevent the electromagnetic wave from leaking through a gap between an open front side of a body and the door. And, the front side of the body and the choke filter configure an electromagnetic wave cut-off circuit (L-C circuit).

And, the door of the electronic oven is configured to be projected to a prescribed height inward the cavity for thermal insulation of a high temperature state within the cavity. Namely, the door is configured to have a thin edge.

A gasket and a glass panel is provided to the door of the heating apparatus using the electromagnetic wave for airtightness and thermal insulation of the inside of the cavity.

The heating apparatus using the electromagnetic wave heats food and drink in a manner of applying the electromagnetic wave having a frequency of about 2.45 GHz suitable for heating the food and drink well to the inside of the cavity.

However, the related art heating apparatus using the electromagnetic wave has the following problems.

First of all, since the gasket and glass panel are installed at the door of the heating apparatus for the thermal insulation, a gap between the front side of the body and the choke filter is unable to avoid increasing. If the gap increases, capacitance (C) of the electromagnetic wave cut-off performance is reduced so that a graph, as shown in FIG. 1, has a sharp peak to considerably reduce an electromagnetic wave absorption bandwidth having the cut-off performance below about 70 dB. Hence, the electromagnetic wave cut-off performance is considerably lowered.

As the gap between the front side and the choke filter increases, the electromagnetic wave absorption bandwidth sensitively varies in a direction of being narrowed. For instance, if a gap between the front side of the body and a coil, as shown in FIG. 1, is 1 mm (G1), the electromagnetic wave absorption bandwidth is about 100 MHz. If the gap between the front side of the body and the coil, as shown in FIG. 1, is 3 mm (G2), the electromagnetic wave absorption bandwidth is about 50 MHz. If the gap between the front side of the body and the coil, as shown in FIG. 1, is 10 mm (G3), there exists almost no electromagnetic wave absorption bandwidth. Yet, in case that the gasket and the glass panel are installed at the door of the heating apparatus, a substantial gap between the front side of the door and the choke filter is about 6~7 mm, it can be seen that the electromagnetic wave cut-off performance is considerably reduced.

Secondly, the cavity has the EMI (electromagnetic interference) characteristic since the electromagnetic wave interference or electromagnetic interference (EMI) is generated by a harmonic frequency due to the interference of the frequency of 2.45 GHz. As the electromagnetic wave bandwidth is reduced, it becomes difficult to eliminate the harmonic frequency.

Thirdly, the volume (size) of the cavity attempts to be increased in a manner of reducing a wall thickness of the body to increase a capacity of the electronic or microwave oven. Once the thickness of the front side of the body is decreased, an area of the front side of the body is decreased so that the capacitance (C) is considerably reduced to decrease the electromagnetic wave cut-off circuit considerably. Thus, limitation is put on reducing the wall thickness of the body.

SUMMARY OF THE INVENTION

Accordingly, the present invention is directed to a heating apparatus using an electromagnetic wave that substantially obviates one or more problems due to limitations and disadvantages of the related art.

An object of the present invention is to provide a heating apparatus using an electromagnetic wave, by which a gap between a front side of a body and a choke filter can be minimized despite installation of a glass panel and gasket.

An object of the present invention is to provide a heating apparatus using an electromagnetic wave, by which cut-off performance of the electromagnetic wave is enhanced by increasing an electromagnetic wave absorption bandwidth having cut-off performance below −70 dB.

Another object of the present invention is to provide a heating apparatus using an electromagnetic wave, by which cut-off performance of a harmonic frequency generated from interference of the electromagnetic wave can be enhanced.

Another object of the present invention is to provide a heating apparatus using an electromagnetic wave, by which electromagnetic wave cut-off performance can be secured even if a front side thickness of a body is reduced.

A further object of the present invention is to provide a heating apparatus using an electromagnetic wave, by which sealing performance of a cavity and door cleaning facilitation are enhanced in a manner of reducing a gap between a front side of a body and a choke filter to increase an approximation effect.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a heating apparatus using an electromagnetic wave according to the present invention includes a door provided to an open front side of a body to be opened/closed, a choke filter having a panel type choke part arranged by at least one or more rows along an edge of the door and a filter part having a plurality of slots wherein a prescribed choke part is provided to a most outer side, and a glass panel attached to an inner lateral side of the door and the choke filter.

Preferably, the choke part arranged to the most outer side is provided to an external end portion of the door.

More preferably, the choke part is bent toward a central portion of the door. More preferably, the filter part is bent toward the central portion of the door.

Preferably, the choke part is bent to lie in a same plane of an inner lateral side of the glass panel.

More preferably, a gasket is further provided between the choke part and an edge of the glass panel to seal a gap between the front side of the body and the door.

Preferably, the filter part is provided to a most inner side of the choke filter.

More preferably, the choke filter is arranged within a range of confronting the front side of the body.

In another aspect of the present invention, a heating apparatus using an electromagnetic wave includes a door provided to an open front side of a body, a choke filter including a panel type choke part arranged along an edge of the door by at least one or more rows, the choke part bent toward a central portion of the door, a filter part having a plurality of slots, the filter part bent toward the central portion of the door wherein a prescribed choke part is arranged on a most outer side and wherein the filter part is arranged at a most inner side, a gasket arranged between the choke part and an edge of a glass panel to seal a gap between the door and the front side of the body, and the glass panel attached to an inner lateral side of the door and the choke filter.

Preferably, the choke filter is arranged within a range of confronting the front side of the body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
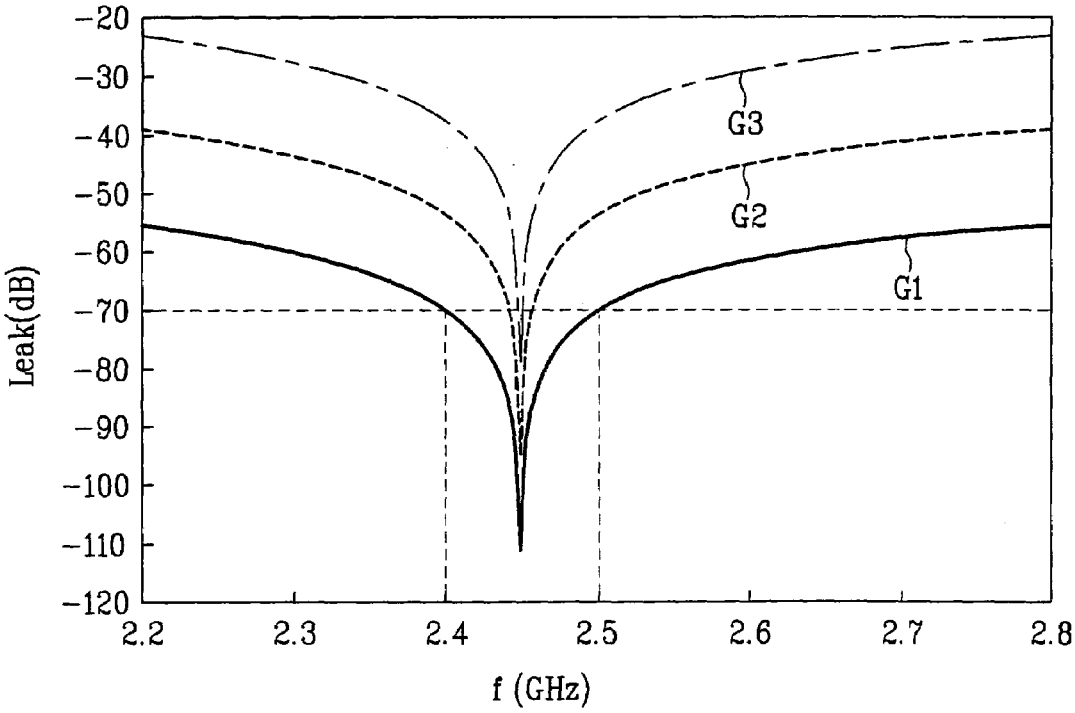
FIG. 1 is a graph of electromagnetic wave cut-off performance of a heating apparatus using an electromagnetic wave according to a related art.
Figure 2:
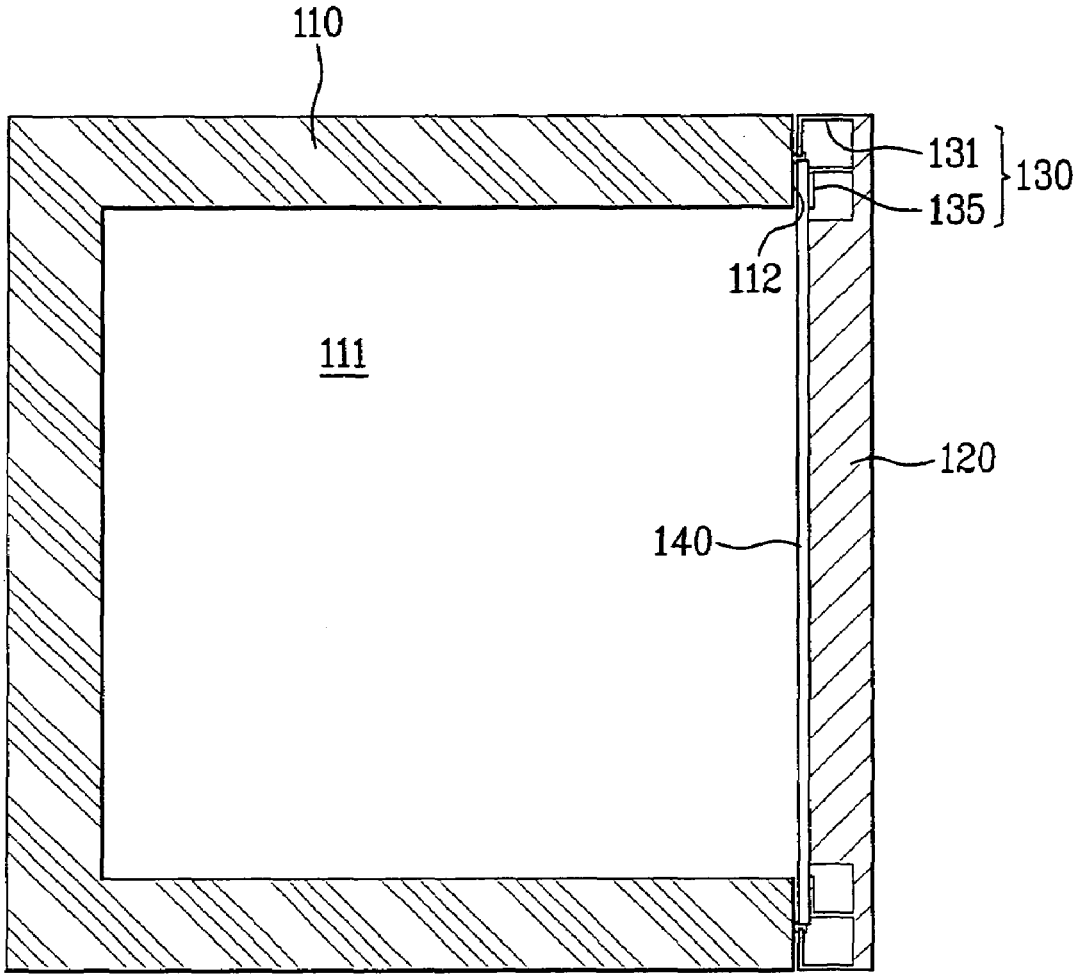
FIG. 2 is a cross-sectional diagram of a heating apparatus using an electromagnetic wave according to an embodiment of the present invention.
Figure 3:
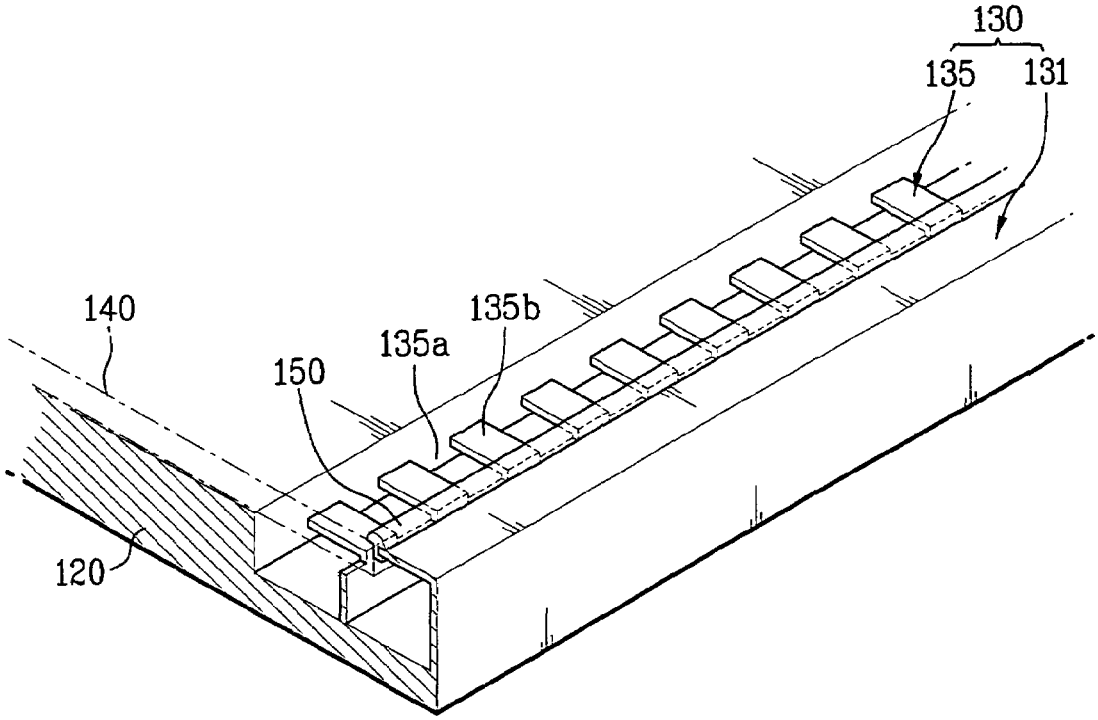
FIG. 3 is a perspective diagram of a choke filter in FIG. 2.

FIG. 2 is a cross-sectional diagram of a heating apparatus using an electromagnetic wave according to a first embodiment of the present invention, and FIG. 3 is a perspective diagram of a choke filter in FIG. 2.

Referring to FIG. 2 and FIG. 3, a heating apparatus using an electromagnetic wave according to a first embodiment of the present invention includes a door 120 provided to an open front side 112 of a body 110 to be opened/closed, a choke filter 130 having a panel type choke part 131 arranged by at least one or more rows along an edge of the door 120 and a filter part 135 having a plurality of slots 135*b* wherein a prescribed choke part 131 is provided to a most outer side, and a glass panel 140 attached to an inner lateral side of the door 120 and the choke filter 130.

A cavity 111 is provided within the body 110 to accommodate food and drink. In this case, a wall side of the body 110 and the front side 112 of the body 112 are formed of a conductor.

The above-configured front side 112 of the body 110 and the choke filter 130 configure an electromagnetic wave cut-off circuit that will be explained later.

The choke filter, as shown in FIG. 3, includes the choke part 131 and the filter part 132. FIG. 2 exemplary shows the choke and filter parts arranged by one row each. Hence, the choke part is arranged at a most outer side and the filter part of at least two rows is arranged within the most outer choke part or the filter and choke parts of at least one or more rows can be arranged. Alternatively, the prescribed filter part is arranged at a most inner side and the filter part of at least two or more rows is arranged outside the most inner choke part or the filter and choke parts of at least one or more rows can be arranged.

In this case, since the choke part 131 is configured to have a panel shape, an electromagnetic wave can be cut off by setting impedance Z to infinity ($\infty$). Since the choke part 131 has an insensitive operational characteristic regardless of being arranged to confront the front side 112 of the body 110 or not to confront the front side 112 of the body 110 in part, the impedance Z shows almost no variation.

Hence, even if the portion of the choke part 131 is arranged not to oppose the front side 112 of the body 110 by decreasing a thickness W of a left/right/top/bottom wall side of the body 110, the almost same impedance can be obtained.

The filter part 135, which includes a plurality of ribs 135*a* and slots 135*b*, configures an L-C circuit to cut off the electromagnetic wave. Since the filter part 135 has the operational characteristic which sensitively varies in case of being arranged not to confront the front side 112 of the body in part, the filter part 135 needs to be arranged to confront the front side 112 of the body to have sufficient cut-off performance.

In case that the choke part 131, as not shown in the drawings, is arranged at the most inner side, the portion of the choke part 131 can be arranged not to confront the front side 112 of the body 110. Hence, a width of the choke filter 130 can be increased. Moreover, if the filter part 135, as shown in FIG. 2 and FIG. 3, is arranged at the most inner side, the choke filter 130 is preferably arranged to confront the front side 112 of the body 110 overall.

The choke filter and the glass panel are explained as follows. In the following description, it is assumed that the choke part 131 and the filter part 135, as shown in FIG. 3, are arranged by one row each.

In the choke filter 130, the choke part 131 is arranged at a most outer side and the filter part 135 is arranged inside the choke part. Alternatively, the choke part 131 is arranged at the most outer side and a separate choke part can be further arranged at a most inner side.

In this case, it is preferable that the choke part 131 is provided to an external end portion of the door 120. This is to substantially extend an area of the choke filter 130 to the external end portion of the door.

The choke and filter parts 131 and 135 are preferably bent to oppose an inside of the door 120. And, each of the choke and filter parts 131 and 135 is bent have a '¬' shape.

And, the choke part 131 is bent to lie in the same plane of an inner lateral side of the glass panel 140. This is to enhance cleaning facilitation in a manner that the inner lateral side of the glass panel 140 lies in the same plane of the choke part 131 by attaching the glass panel 140 to the inner lateral side of the door 120. Moreover, by minimizing the gap between the front side 112 of the body 110 and the choke part 131, it is more advantageous for the electromagnetic wave cut-off and the air-tightness of the cavity.

It is preferable that the slits 135*b* of the filter part 135 are arranged to be spaced apart from each other by the same interval. Yet, it is also understandable that they can be arranged by uneven intervals.

Preferably, a gasket 150 is further provided between the choke part 131 and an edge of the glass panel 140. The gasket 150 seals a gap between the glass panel 140 and the door 120.

An operation of the heating apparatus according to the present invention is explained with reference to FIG. 4 and FIG. 5 as follows.

Figure 4:
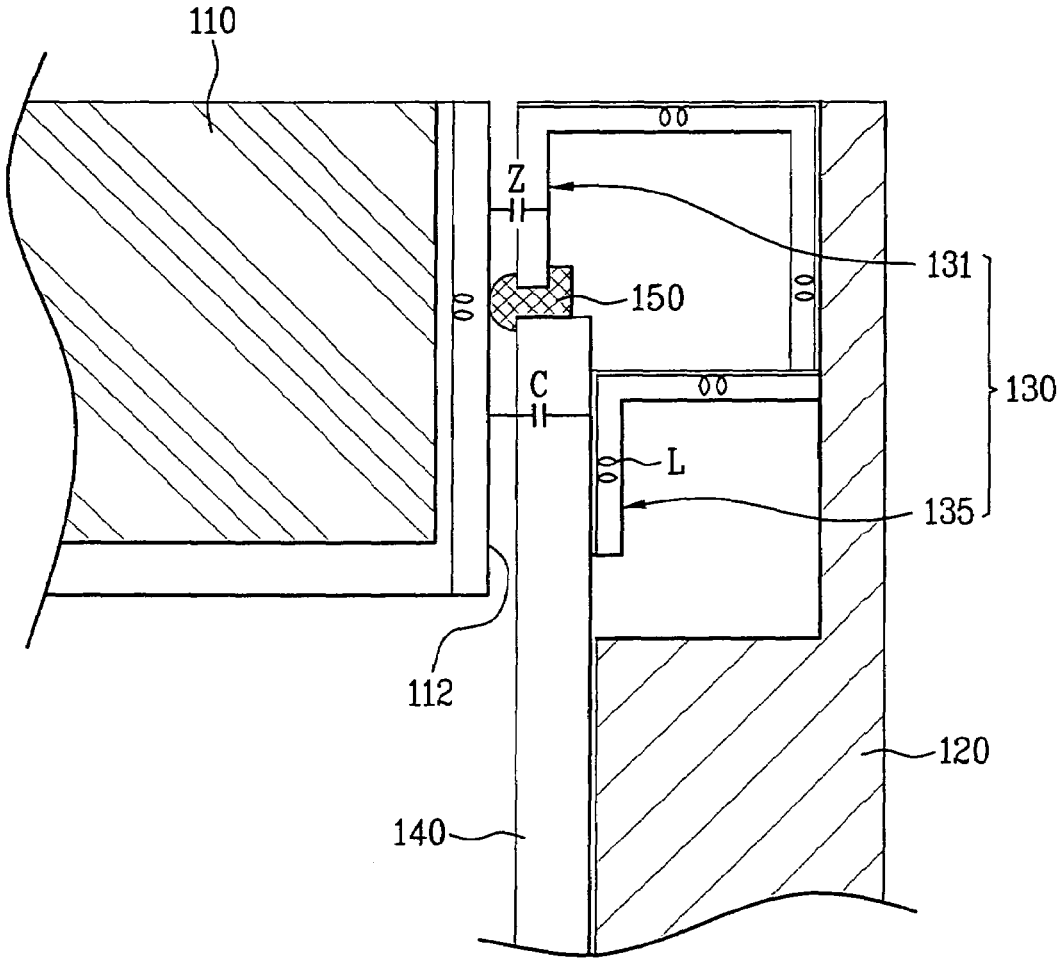
FIG. 4 is a magnified cross-sectional diagram for explaining an action of an electromagnetic wave cut-off circuit of the heating apparatus shown in FIG. 2.
Figure 5:
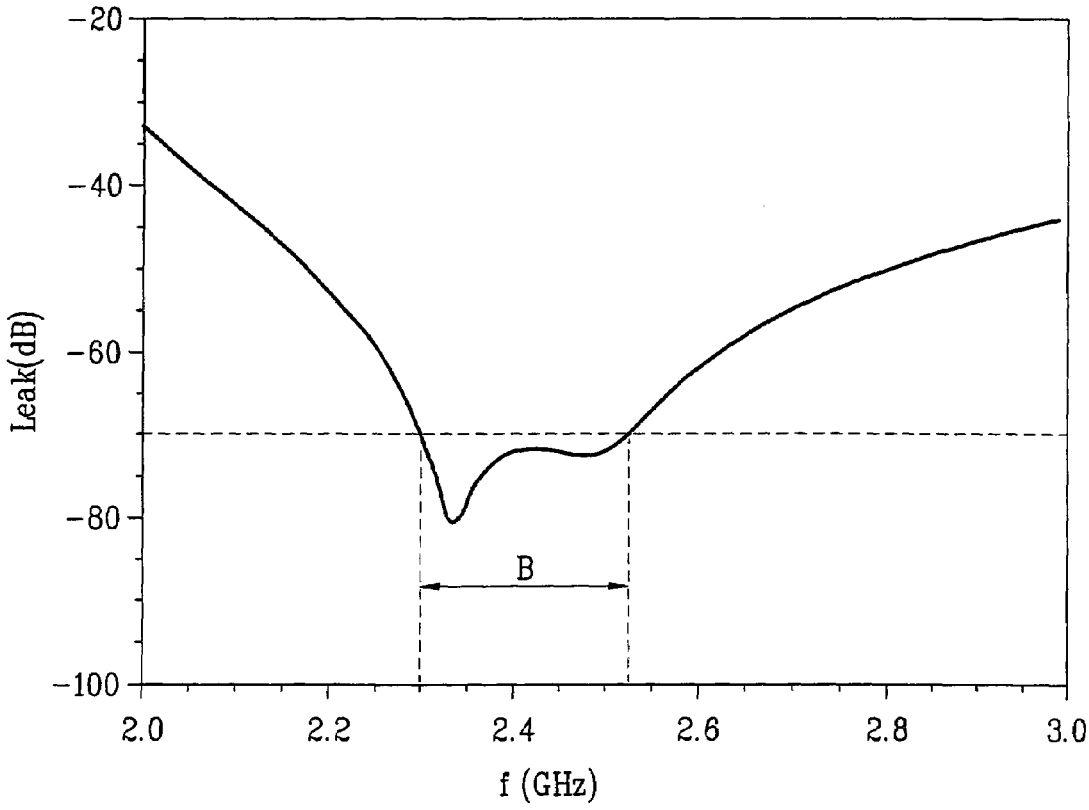
FIG. 5 is a graph of electromagnetic wave cut-off performance of the heating apparatus shown in FIG. 2.

Referring to FIG. 4 and FIG. 5, an electromagnetic wave of about 2.45 GHz is applied to an inside of the cavity 111 of the heating apparatus. The applied electromagnetic wave is reflected by the conductive cavity 111, a stirrer fan (not shown in the drawing) and the like in all directions to heat the food and drink.

In doing so, the L-C circuit is configured in the filter part 135 to primarily cut off the leaking electromagnetic wave. Simultaneously, by setting the impedance Z to infinity (∞) in the choke part 131, the leaking electromagnetic wave is secondarily cut off. For instance, as shown in FIG. 4, a value 'L' is formed on the open front side 112 of the body and a surface of the filter part 135. Simultaneously, a value 'C' is formed in the space between the front side 112 of the body and the filter part 135, in the inner space of the filter part 135 and in the slots 135*a* of the filter part 135. Namely, the value 'L' is formed on the surface, while the value 'C' is formed in the gap between the elements and in the corresponding space. Hence, the infinitive impedance Z and the L-C circuit (i.e., dual cut-off circuit) are configured in the body 110 and the choke filter 130 to considerably enhance the electromagnetic wave cut-off performance.

FIG. 5 is a graph of electromagnetic wave cut-off performance of the heating apparatus shown in FIG. 2, in which a gap between the front side 112 of the body 110 and the choke filter 130 is neared and for which the choke filter 130 having the choke part 131 and the filter part 135 is used.

The choke filter 130 substantially configures the dual cut-off circuit with the impedance Z and the L-C circuit. Due to the dual cut-off circuit, a leakage in the bandwidth B between 2.15~2.75 GHz amounts to −70 dB or below. Namely, the electromagnetic wave absorption bandwidth B having the leakage of −70 dB is considerably increased higher than that of the related art. In this case, 'dB=10 log(output value/input value)', the input value is a value of the electromagnetic wave applied to the inside of the cavity, and the output value indicates a leakage value of the electromagnetic wave.

Hence, since the bandwidth B of 2.15~2.75 GHz shows a leakage amount below −70 dB, it can be seen that the electromagnetic wave cut-off performance is considerably raised. Specifically, since the electromagnetic wave of 2.45 GHz applied to a general electronic or microwave oven belongs to the above-explained electromagnetic wave absorption bandwidth B, it is able to considerably prevent the electromagnetic wave from leaking through the gap of the door 120.

The bandwidth B can be increased since the choke part 131 and the front side 112 of the body 110 are neared to be almost attached together.

And, as the electromagnetic wave absorption bandwidth B is considerably raised, the cut-off performance for the harmonic frequency is considerably enhanced.

Thus, as the electromagnetic wave cut-off performance is considerably enhanced, it is able to sufficiently secure the electromagnetic wave cut-off performance even if the width of the top/bottom/left/right wall of the body is set smaller than that of the related art.

Accordingly, the present invention provides the following effects or advantages.

First of all, as the gap between the front side of the body and the choke part is reduced to increase the capacitance (C), the present invention employs the choke filter having the choke part and the filter part, thereby cutting off the electromagnetic wave doubly.

Hence, as the electromagnetic wave absorption bandwidth having the cut-off performance below about 70 dB is considerably raised, the cut-off performance of the electromagnetic wave is enhanced. And, the harmonic frequency cut-off performance can be enhanced as well.

Secondly, since the electromagnetic wave absorption bandwidth is increased, it is able to prevent the electromagnetic wave absorption bandwidth from being sensitively varied even if the thickness of the wall of the body is decreased. And, the present invention can further enhance the electromagnetic wave cut-off performance and the EMI (electromagnetic interference) characteristic.

Thirdly, since the thickness of the wall of the body is reduced, it is able to increase the capacity of the cavity of which inside is extended.

Fourthly, since the choke part and the glass panel lie in the same plane, the choke part and the front side of the body are almost attached to each other when the door is closed. Hence, it is able to facilitate the cavity to be cut off. And, the choke part and the glass panel are smoothly connected to facilitate cleaning.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A heating apparatus using an electromagnetic wave, comprising:

a body forming a cavity for accommodating foods;

a door provided to an open front side of the body;

a choke filter including a choke part arranged by at least one row each along an edge of the door and a filler part arranged by at least one row each along the choke part, the filter part comprising a plurality of ribs and slots formed between two adjacent ribs;

a glass panel provided to an inner lateral side of the door and covering a top surface of the filter part; and a gasket provided between the choke part and an edge of the glass panel in order to seal a gap between the front side of the body and the door, wherein a top surface of the choke part and a top surface of the filler part form different planes.

2. The heating apparatus of claim 1, wherein one choke part among choke parts arranged by rows along an edge of the door is positioned at the most outer side of the choke filter.

3. The heating apparatus of claim 1, wherein the choke part is bent toward a central portion of the door.

4. The heating apparatus of claim 1, each of the two adjacent ribs has a base portion of the rib and a tip of the rib extending from the base portion toward the central portion of the door.

5. The healing apparatus of claim 1, wherein the top surface of the choke part facing the body and a surface of the glass panel facing the body are coplanar.

6. The heating apparatus of claim 1, wherein one filter part among filter parts arranged by rows along an edge of the door is positioned at the most inner side of the choke filter.

7. The heating apparatus of claim 1, wherein the choke filter is arranged within a range of confronting the front side of the body.

8. The heating apparatus of claim 1, wherein the choke part has a panel shape.

9. A heating apparatus using an electromagnetic wave, comprising:

a body forming a cavity for accommodating foods;

a door provided to an open front side of the body;

a choke filter including a choke part arranged by at least one row each along an edge of the door anal a filter part arranged by at least one row each along the choke part, a top surface of the choke part and a top surface of the filter part forming different planes; and a glass panel provided to an inner lateral side of the door and covering a top surface of the filter part, wherein absorption of the electromagnetic wave by the choke part has a maximum at a first frequency, absorption of the electromagnetic wave by the filter part has a maximum at a second frequency, and a centre frequency of the electromagnetic wave is outside of a range between the first frequency and the second frequency in order to increase the electromagnetic wave absorbtion bandwidth.

10. The heating apparatus of claim 9, wherein the first frequency and the second frequency are above the centre frequency.

11. The heating apparatus of claim 9, wherein the first frequency is greater than the second frequency.

12. The heating apparatus of claim 9, wherein the first frequency is smaller than the second frequency.

13. The heating apparatus of claim 9, wherein the center frequency is 2.45 GHz.

* * * * *